US006725586B2

(12) United States Patent
Horcher et al.

(10) Patent No.: US 6,725,586 B2
(45) Date of Patent: Apr. 27, 2004

(54) SELF-CLEANING IRON

(75) Inventors: Roger Horcher, Offenbach (DE); Klaus Maier, Offenbach (DE); Ulrich Demuth, Erbach (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 10/380,268

(22) PCT Filed: Sep. 11, 2001

(86) PCT No.: PCT/IB01/02531

§ 371 (c)(1),
(2), (4) Date: Mar. 12, 2003

(87) PCT Pub. No.: WO02/22939

PCT Pub. Date: Mar. 21, 2002

(65) Prior Publication Data

US 2003/0177673 A1 Sep. 25, 2003

(30) Foreign Application Priority Data

Sep. 12, 2000 (FR) ..... 00 11562

(51) Int. Cl.[7] ..... D06F 75/18
(52) U.S. Cl. ..... 38/77.83
(58) Field of Search ..... 38/74, 77.83, 77.3, 38/77.1, 77.5, 77.8; 251/89, 149, 149.1, 205, 279, 333, 349, 368

(56) References Cited

U.S. PATENT DOCUMENTS 3,474,552 A * 10/1969 Swenson ..... 38/77.8
3,889,406 A 6/1975 Chivers et al.
4,079,528 A * 3/1978 Lindstaedt et al. ..... 38/77.83
4,760,658 A * 8/1988 Emig et al. ..... 38/77.7
5,924,224 A * 7/1999 Demuth et al. ..... 38/77.8
6,167,643 B1 * 1/2001 Dodier et al. ..... 38/77.8

FOREIGN PATENT DOCUMENTS

| | | |
|---|---|---|
| DE | 34 05 465 | 9/1985 |
| DE | 44 12 825 | 10/1995 |
| DE | 297 20 259 | 2/1998 |
| FR | 2 156 103 | 5/1973 |
| WO | 98 09015 | 3/1998 |

* cited by examiner

*Primary Examiner*—Ismael Izaguirre
(74) *Attorney, Agent, or Firm*—Browdy and Neimark PLLC

(57) ABSTRACT

The invention concerns a flash iron comprising a water reservoir (2), a flash chamber (32) and a drip device having an axially mobile rod (4) whereof the total stroke comprises a first travel enabling the steam to flow towards the orifice (520) of a module (5) and a second travel moving the module (5) by opening a wider orifice (220) for water passing from the reservoir (2) to the flash chamber (32). The invention is characterised in that the tightness between the reservoir (2), the module (5) and the flash chamber (32) is provided by a first compressed seal, and the tightness between the rod and the module is provided by a second compressed seal, the two seals being parts of one and the same elastomeric component (52) borne by the module (5).

5 Claims, 5 Drawing Sheets

SELF-CLEANING IRON

Figure 1:
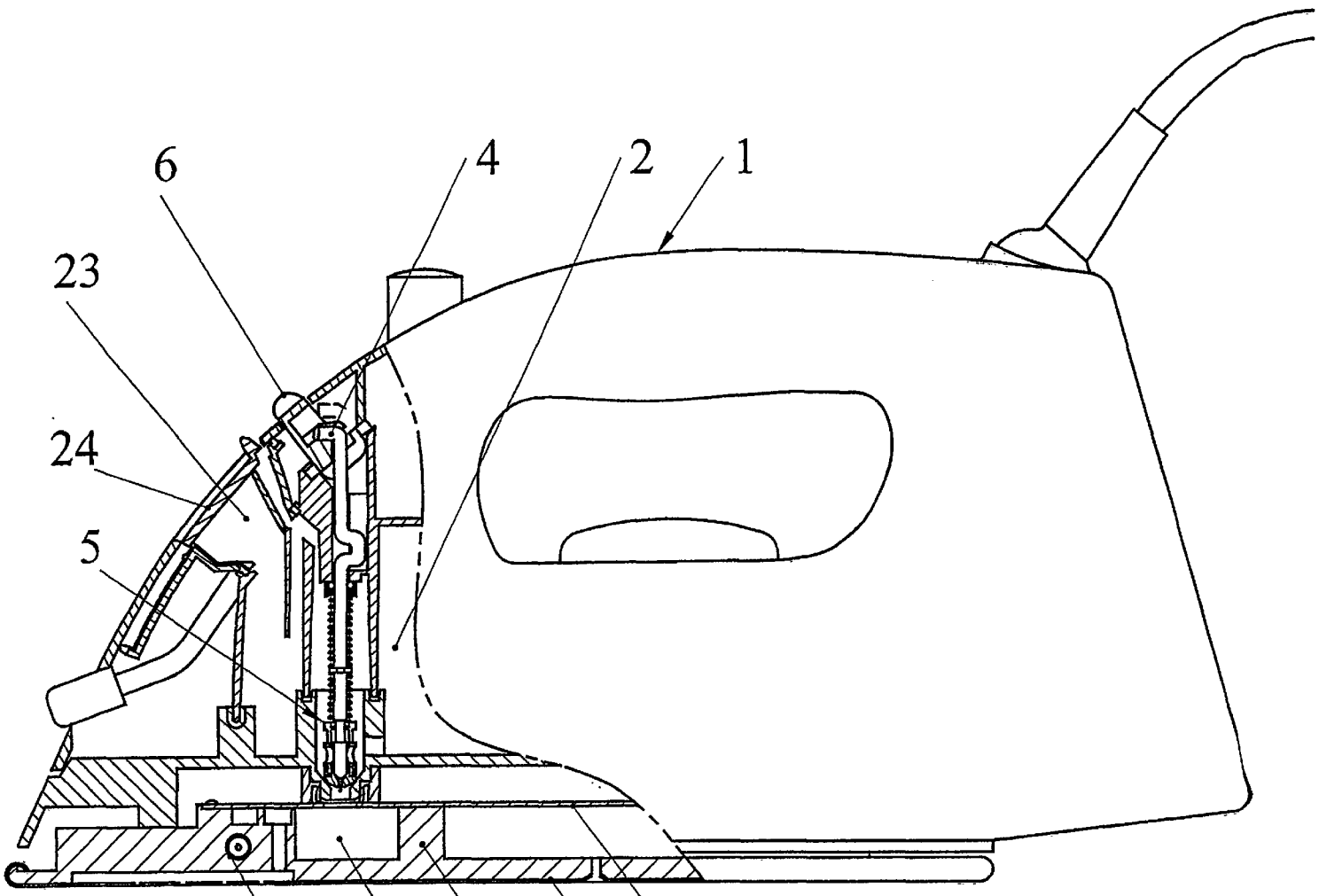

The present invention concerns steam irons in which the water furnished by a reservoir is vaporized in a quasi-instantaneous manner in a steam chamber, and which comprise means for cleaning the interior of this chamber. These means consist of a relatively large opening provided in the bottom of the internal reservoir through which said reservoir can be rapidly emptied directly into the steam chamber, thus provoking a jet of water and steam which purges the iron.

An iron of this type is described in the patent FR2156103. The bottom of the reservoir has on the one hand an orifice furnished with a device for regulating the flow of water falling onto the bottom of the chamber where it is vaporized, on the other hand an orifice of large dimensions independent of the first and the opening of which can be controlled separately. This type of arrangement has as a drawback that it occupies a large amount of space in the iron, which limits the possibilities of design and optimization of the volume of the reservoir, twice the controls and consequently increases the cost.

The patent FR2287549 shows an iron having a single control to regulate the vaporization and to assure cleaning. The bottom of the reservoir has an orifice provided with a needle valve that regulates the flow thereof during vaporization. The needle valve can be withdrawn completely to assure a larger flow and cleaning of the iron. However, the maximum cross section of the passage is limited by the dimensions of the needle valve, which cannot be too large, having to regulate a small flow. By this fact, the function of self-cleaning is not as effective as desired.

The patent DE4412825 shows an iron of which the drip device is removable. The seat of the needle valve is mounted on a tube that obstructs the orifice of the reservoir, an orifice having a large cross-section. This removability can be beneficially used to clean the drip device, but also to purge the hot iron. However, the self-cleaning operation is difficult since it is necessary to hold the hot iron with one hand, while the drip device is removed with the other. Moreover, the seal assuring sealing between the reservoir and the steam chamber tightly hugs the tube, which requires a long disengagement travel to assure the self-cleaning of the iron. In addition, the needle of the needle valve bears directly on a part of the tube in the form of a seat, but which does not have the flexibility of a seal and is subject to wear and sealing defects.

The patent DE3405465 shows a drip device of which the shank can be progressively lifted to assure the vaporization flow through a first orifice provided in a module concentric with the shank. Beyond the maximum vaporization travel, the shank can continue to be lifted. Then the module that closes a larger orifice concentric with the first is lifted. This frees a large cross section for passage toward the vaporization chamber and assures cleaning of the iron. But the device designed above all to prevent deposits on the drip device has poor lateral sealings.

The invention herebelow has for its object a steam pressing iron equipped with a device combining on a same axis and with a same control a drip device and a self-cleaning function and which does not have the drawbacks cited above.

Primarily the object of the invention is achieved by a flash iron having a water reservoir, a steam chamber and a drip device having an axially displaceable shank, the total travel path of which comprises a first path assuring the flow of vaporization through the orifice of a module and a second path displacing the module while opening a larger orifice for the passage of water from the reservoir toward the steam chamber, characterized in that the sealing between the reservoir, the module and the steam chamber is assured by a first compressed seal, and in that the sealing between the shank and the module is assured by a second compressed seal, the two seals being parts of one and the same elastomer part carried by the module.

Usefully, the vaporization control is accessible to the hand that supports the iron. With the same control, one can regulate the flow and one can also, by pushing the control at the end of its travel path, effect cleaning of the iron. The other hand remains available for better operating safety.

The utilization of a compressed elastomer seal, rather than a sliding seal, between the module and the wall that separates the reservoir from the chamber permits an adaptation to micro defects of the seat and has the advantage of only requiring a short travel path for opening the orifice.

The utilization of a compressed elastomer seal, rather than a sliding seal, between the needle and module assures a good sealing at closing but is above all an arrangement that is less sensitive to scaling and to wear or corrosion.

The two seals being combined in a single piece, their fabrication and their installation are simultaneous, which is a source of economies.

Preferably, the part constituting the two seals carries the orifice for flow of water for vaporization.

The elastomer orifice is less sensitive to scaling and more easily cleaned by the needle valve of the needle.

Preferably, the part constituting the two seals connects them in a continuous and sealed manner.

In this manner, sealing is achieved between the two concentric orifices, that is to say between the needle and the wall that separates the reservoir from the steam chamber. A leak around the module is without consequence.

The invention will be better understood in view of the examples herebelow and the attached drawings.

FIG. 1 is a longitudinal view of a pressing iron according to the invention, in partial cross section of the front of the iron.

Figure 2:
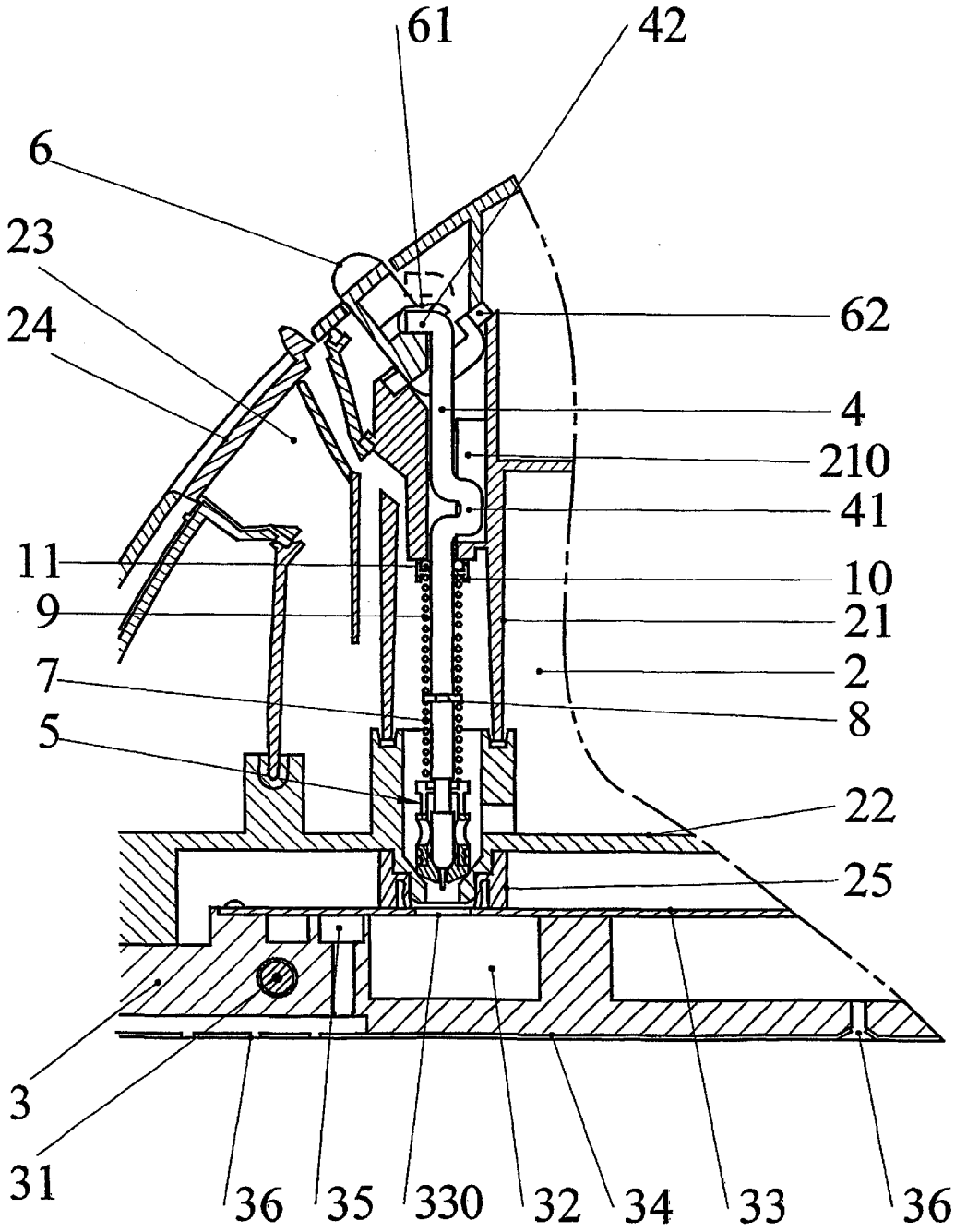

FIG. 2 a partial longitudinal cross section of the iron in the region of the drip device.

Figure 3:
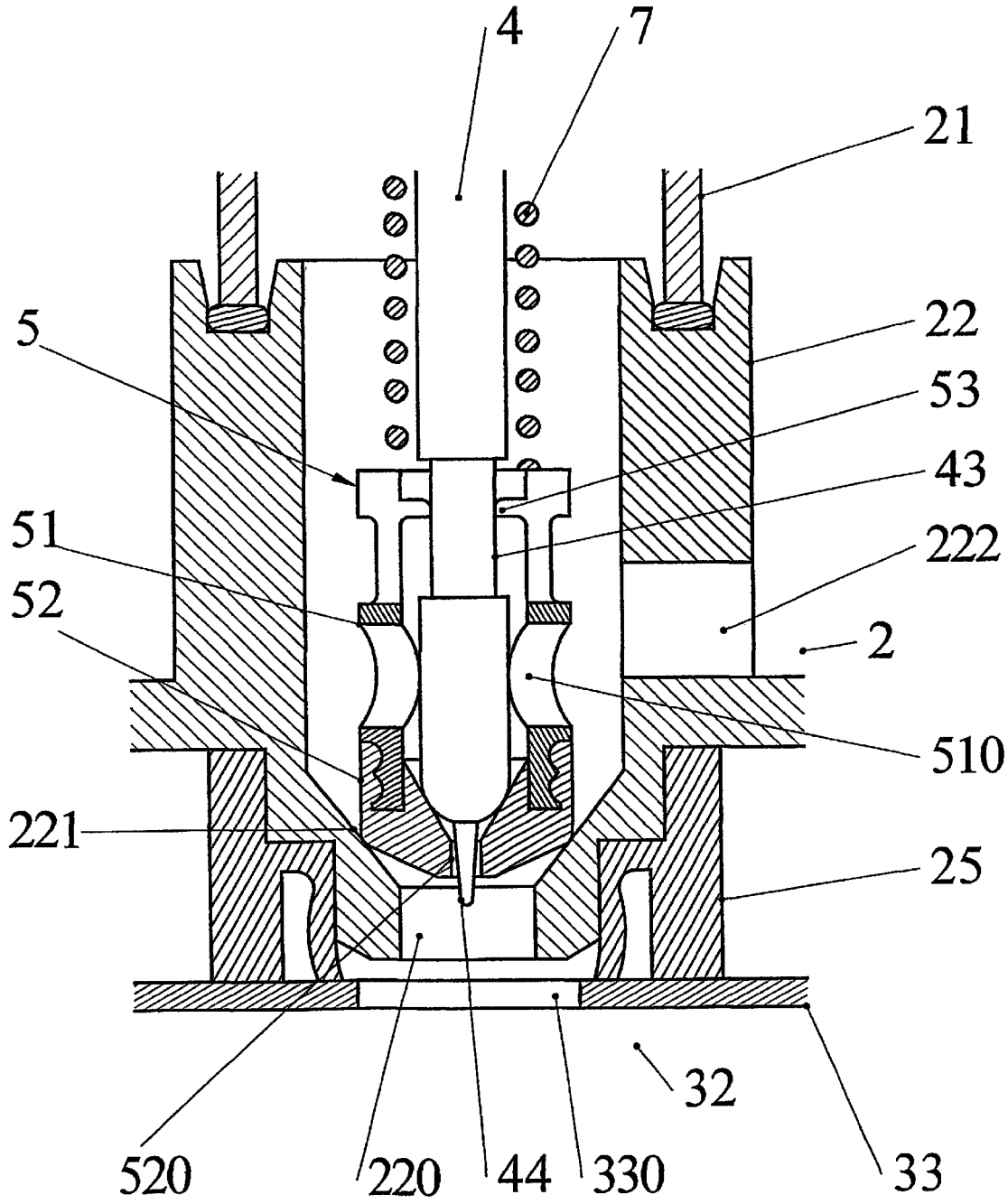

FIG. 3 is a cross-sectional detail view of the drip device.

FIGS. 4*a* to 4*d* are a set of four views in cross section of the drip device in different regulating positions.

Figure 5:
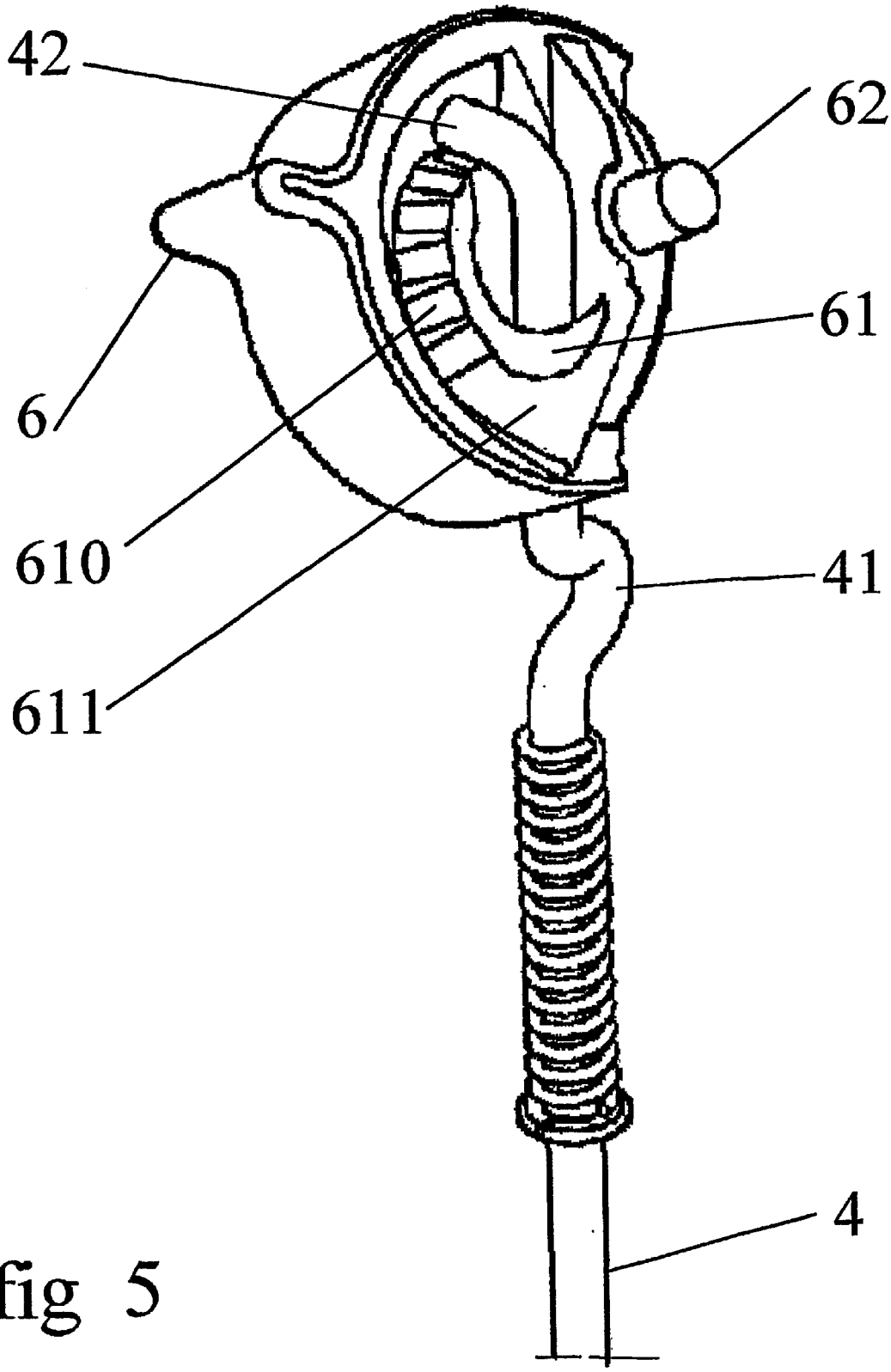

FIG. 5 is a perspective view of the control for the drip device.

In a preferred form of construction (FIGS. 1 and 2), steam iron 1 has a reservoir 2 made of two main parts 21, 22 and having a filling orifice 23 closed by a protective cap 24, a heating body 3 furnished with a heating element 31, and a steam chamber 32 in heating body 3 being closed by a plate 33, a thin soleplate 34 in thermal contact with heating body 3 providing the surface in contact with the fabric during ironing. Distribution channels 35 and steam holes 36 in heating body 3 and soleplate 34 assure evacuation of the steam into the cloth.

Closing plate 33 is pierced by a hole 330 (FIGS. 2 and 3) in the axis of a drip device through which water to be vaporized is introduced into steam chamber 32. The drip device is housed in a shaft constituted by parts 21, 22 of the reservoir. The sealing between the reservoir carrying the drip device and closing plate 3 is assured by a seal 25 compressed between pieces 22 and 33.

The drip device has a shank 4 biased toward the bottom by a spring 9, a control 6 displacing shank 4 axially, a module 5 biased toward to the bottom by a spring 7 that is weaker than the former.

Shank 4 has along a part of its length a U 41 perpendicular to its axis. This axis introduced into a groove 210 of the reservoir, assures immobilization of shank 4 in rotation. Upper end 42 of shank 4 is bent to bear on a cam 61 of control 6. A washer 10 constitutes with a seal 11 the support for spring 9 on reservoir part 21 while a slotted washer 8 secured to shank 4 constitutes its support on shank 4. Washer 8 serves equally to support spring 7.

Control 6, better seen in FIG. 5, is a button that can turn about bearings 62. In a convenient manner permitting a good integration of the control to the housing of the iron, the bearing axis intersects the axis of shank 4 in an oblique direction and cam 61 is designed accordingly.

Cam 61 has a crenellated surface 610 that lifts the shank by its end 42 with a first slope and a second smooth surface 611 as a continuation of the first surface lifting the shank along a second slope that is steeper than the first. The crenellations permit shank 4 to be maintained in the position to which it has been raised while smooth surface 611 does not permit the position to be maintained when the user releases the control.

Module 5, more clearly visible in FIG. 3, has a substantially cylindrical hollow part 51 that allows passage of the end of shank 4 and is snap fitted by a lip 53 in a groove 43 of this shank. More particularly, according to the invention, the path of travel of shank 4 in the module is thus limited by the width of groove 43. A cylindrical part 52 of elastomer is fixed at the end of the module.

This part 52 is pierced with a calibrated orifice 520 and constitutes an elastomer seat compressed by the rounded end of shank 4 pushed by spring 9. Sealing is thus assured between the reservoir and part 51 of the module the same as between the reservoir and orifice 520 supplying the steam chamber. A slightly conical extension 44 of shaft 4 passes through orifice 520 and assures the cleaning thereof at each maneuver while permitting a progressive opening of the passage in orifice 520 when shank 4 is lifted. The outside of the elastomer part pushed toward the bottom by spring 7 constitutes on its circular peripheral end a seal that bears while compressing on a seat 221 of lower part 22 of the reservoir. The elastomer part obstructs an orifice 220 concentric with orifice 520 but of much larger cross section. Sealing is thus assured between the reservoir and part 51 of the module the same as between the reservoir and orifice 220 supplying steam chamber 32.

Part 52 is unitary and unbroken between the seat of shank 4, the span of seat 21 of part 22 and orifice 520, in a manner such that the sealing realized by the structure on part 51 of the module is not critical, no leak toward chamber 32 being able to be produced between the span of shank 4 and the span on seat 221.

In a preferred form of the construction, part 52 of LSR (LSR represents Liquid Silicone Rubber) silicone elastomer has a Shore hardness of the order of 50. Orifice 520 for the flow of vaporization water has a diameter of the order of 1 to 1.5 millimeters to control flow rates of the order to 25 to 30 grams of water per minute. The end of shank 4 bears on a conical seat of part 52 of which an apex angle is around 60°, permitting a good support of the sides on part 51 of module 5. Flow orifice 220 for the self-cleaning water has a diameter of the order of 5 millimeters. Part 52 is supported on a conical seat 221 having an apex angle of the order of 75° for a good centering and a good compression of part 52 under the action of spring 7. Preferably, shank 4 bears on its seat on a zone that is higher than the bearing zone of elastomer part 52 on cone 221. From this arrangement it results that part 52 is in particular compressed when at rest under the action of the springs.

Water contained in reservoir 2 enters into the shaft containing the drip device through an opening 222.

Figure 4D:
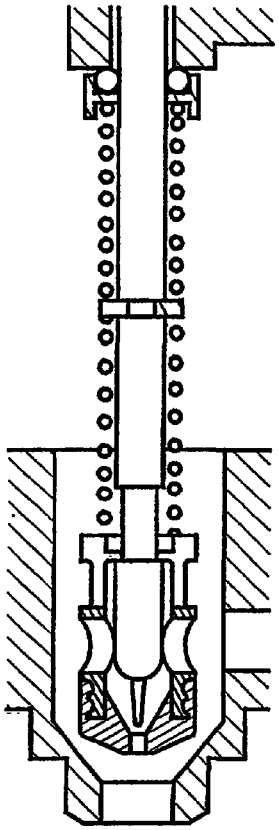
Figure 4C:
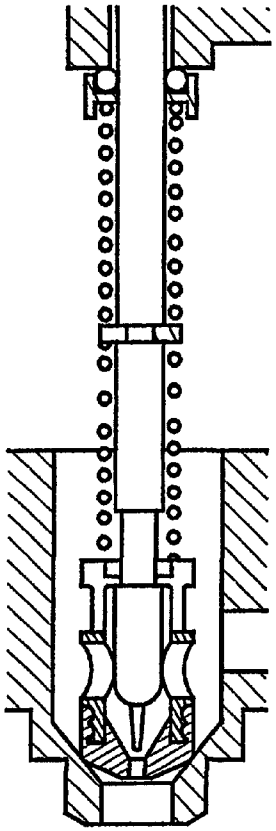

In the waiting and ironing stop position, water is prevented from passing toward steam chamber 32 by large orifice 220 because part 52 is pressed against seat 221 by spring 7. Water penetrates to the interior of module 5 but is prevented from passing though orifice 520 because shank 4 is pushed against its elastomer seat by spring 9. This waiting position is shown in FIG. 4*a*.

Figure 4B:
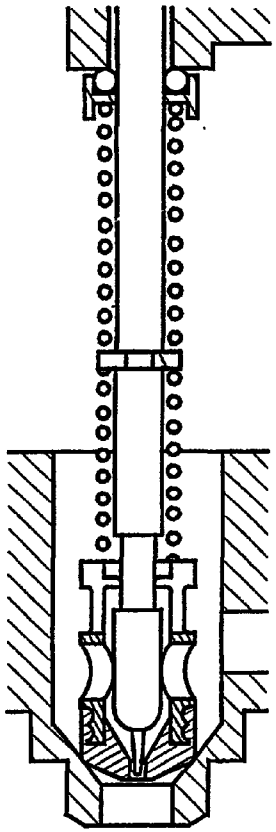
Figure 4A:
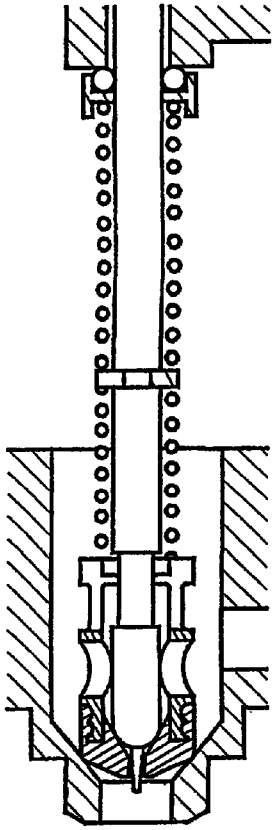

In FIG. 4*b*, the user has acted on button 6 and surface 610 of cam 61 has lifted shank 4 against the force of spring 9. Shank 4 is no longer pressed on its seat and water can flow through orifice 520 with a flow rate that depends on the height position of shank 4 and its extension 44.

FIG. 4*c* shows the maximum drip position when the iron produces steam at a full rate and continuously. This position is the end of vaporization travel. Extension 44 of shank 4 has completely separated from orifice 520 and water flows at a maximum rate toward the steam chamber. Lip 53 of module 5 is at one end of groove 43 of shank 4 while upper end 42 of shank 4 is at the boundary of surfaces 610 and 611 of cam 61.

One sees in FIG. 4*d* the drip position when the user pushes fully on the control 6, along a path of travel that permits self-cleaning of the iron, starting from the preceding position. Upper end 42 of shank 4 is in equilibrium on surface 611 of cam 61, maintained by the pressure on the control that is opposed to the biasing action of spring 9. Shank 4 has displaced module 5 by lip 53 hooked onto an edge of groove 43. As a result, part 52 of module 5 has been raised and no longer assures the sealing toward orifice 220 of large cross section. Water flows from reservoir 2 toward chamber 32 with a large flow rate that assures self-cleaning of the iron.

The slope of surface 611 of the cam being greater than that of surface 610, the control becomes harder when one wishes to perform a self-cleaning of the iron, and this action cannot be performed erroneously. This large slope has for its advantage to facilitate restoring by spring 9 to the normal steaming position. It is thus sufficient for the user to release the control in order to end the self-cleaning.

Compression of the elastomer is negligible before opening of the valves thus formed, which minimizes the travel path of shank 4 and the dimensions of cam 61.

By these means one obtains a steaming function and a self-cleaning function of the iron which are easy to use with an optimized space utilization. The double sealing obtained by a single part is very reliable due the utilization of an elastomer that holds up well against wear as well as against scaling and is economical to fabricate.

What is claimed is:

1. A flash iron (1) having a water reservoir (2), a steam chamber (32) and a drip device having an axially displaceable shank (4), the total travel path of which comprises a first path assuring the flow of vaporization through the orifice (520) of a module (5) and a second path displacing the module (5) while opening a larger orifice (22) for the passage of water from the reservoir (2) toward the steam chamber (32), characterized in that the sealing between the reservoir (2), the module (5) and the steam chamber (32) is assured by a first compressed seal, and in that the sealing between the shank and the module is assured by a second compressed seal, the two seals being parts of one and the same elastomer part (52) carried by the module.

2. Iron according to claim 1 characterized in that the part (52) constituting the two seals carries the orifice (520) for flow of water for vaporization.

3. Iron according to claim 2 characterized in that the part (52) constituting the two seals connects them in a continuous and sealed manner.

4. Iron according to claim 3 characterized in that the shank (4) bears on its seat on a zone that is higher than the bearing zone of the elastomer part (52) on its seat (221).

5. Iron according to claim 1 characterized in that the displacement control of the shank (4) comprises a rotatable button (6) the axis of rotation of which is oblique with respect to the axis of the shank (4).

* * * * *